United States Patent [19]

Depka

[11] 3,965,231

[45] June 22, 1976

[54] MEANS AND METHOD FOR DEFEATHERING BLOCKS

[75] Inventor: Charles W. Depka, Carlsbad, Calif.

[73] Assignee: Modern Builders Supply Co., Oceanside, Calif.

[22] Filed: Apr. 7, 1975

[21] Appl. No.: 565,646

[52] U.S. Cl. ..... 264/161; 125/6; 125/26; 225/103; 425/404

[51] Int. Cl.[2] ..... F28C 3/06

[58] Field of Search ..... 125/2, 3, 4, 5, 6, 26; 225/98, 103; 425/404; 264/161

[56] References Cited

UNITED STATES PATENTS

| | | | |
|---|---|---|---|
| 136,001 | 2/1873 | Odgers | 125/6 |
| 315,962 | 4/1885 | Ross | 125/2 |
| 600,989 | 3/1898 | Hinsdale | 125/6 |
| 1,397,227 | 11/1921 | Minor | 125/26 |
| 3,671,165 | 6/1972 | Schwellenbach | 425/455 |

FOREIGN PATENTS OR APPLICATIONS

| | | | |
|---|---|---|---|
| 658,614 | 4/1938 | Germany | 125/26 |

*Primary Examiner*—Harold D. Whitehead
*Attorney, Agent, or Firm*—Duane C. Bowen

[57] ABSTRACT

Blocks are defeathered by a multiplicity of simultaneous blows from below repeated on a line transversely of the path of travel in conveying dried blocks away from drying racks at a block making machine. The blows are delivered by a series of washers hung on a rod and struck upwardly by a squared, powered shaft rotating therebelow.

13 Claims, 7 Drawing Figures

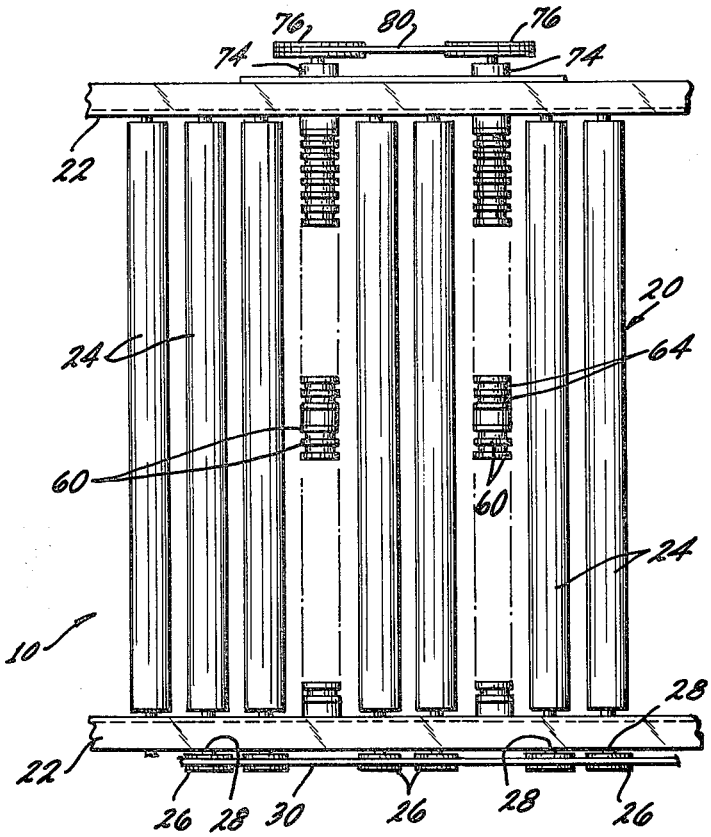
FIG. 5
FIG. 7
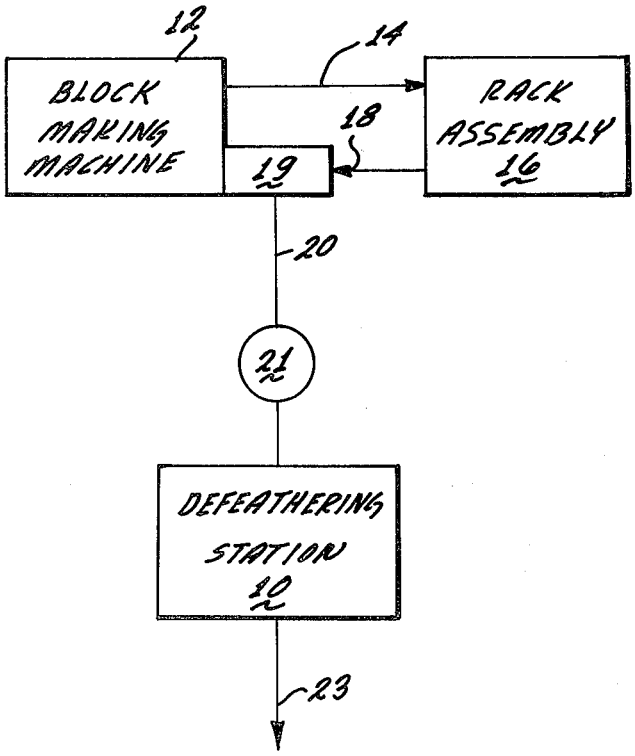
FIG. 6
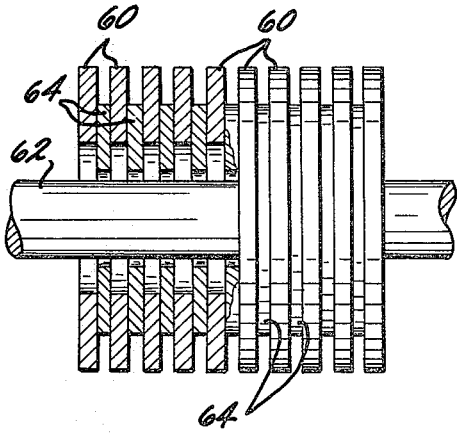

MEANS AND METHOD FOR DEFEATHERING BLOCKS

BRIEF SUMMARY OF THE INVENTION AND OBJECTIVES

My invention relates to a means and method for defeathering blocks economically, particularly at the same time they are being conveyed away from drying racks at a block making machine.

Feathers on blocks are a particular problem with slump blocks, as cement tends to form flange-like extrusions at various points at the lower surfaces as the blocks are being forcibly slumped on a supporting pallet by shoes of a head stripping the blocks from a mold in a block making machine. One objective of my invention is particularly to provide a means and method for defeathering slump blocks, although they may also be used on other blocks.

It would be economical to integrate defeathering into the process of conveying blocks away from drying racks at a block making machine and an additional advantage is to defeather before any manual handling of blocks. One disadvantage of feathers is abrasion or even cutting of the hands of workers, even protected with gloves, as they handle blocks. Feathers also are undesirable in laying up cement block walls in blocking off areas where otherwise morter would be free to flow. Such integration is another objective of my invention.

Cement is known for hardness of a dried cementitious mass and for the hardness of the aggegate therein. In defeathering blocks, desirable features include means to adequately defeather the blocks (to strike the feathers hard enough to knock off or blunt them) and durability of the means used so that they will have a reasonable life as against wear by chipping, abrasion, breaking, etc. To provide said features is an additional objective of my invention.

Further objectives include to provide an efficient and effective means and method, to provide such means and method that does not require operator attendance, and to devise means that is economical to manufacture and requires little maintenance.

My invention will be best understood, together with additional objectives and advantages thereof, from the following description, read with reference to the drawings, in which:

FIG. 5 is a top view of the apparatus.

FIG. 6 is an enlarged, partial top view, partly in section, of the washer assembly in the apparatus.

FIG. 7 is a block diagram illustrating the relationship of defeathering to other block making operations.

Figure 1:
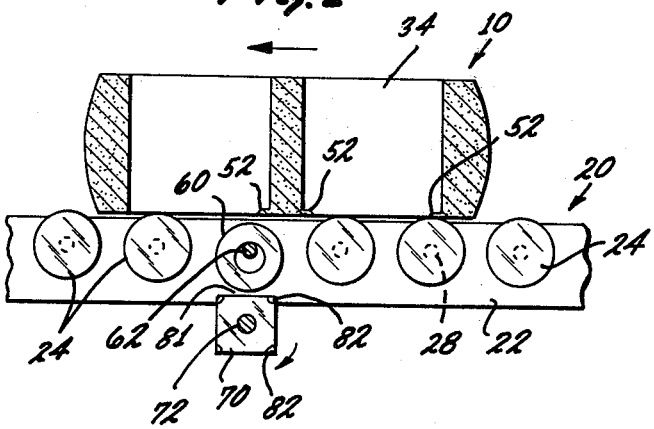
FIG. 1 is a partial side view, partly in section, of a specific embodiment of my block defeathering apparatus.

I will first deal with integration of the means and method into the normal dried block unloading cycle, as indicated in the block diagram of FIG. 7. Citation is made to the Besser Vibrapac, a cement block making machine, a product of the Besser Company of Alpena, Michigan, and its associated equipment for loading newly formed blocks on racks, for unloading dried blocks from racks and conveying them away, and for returning unloaded pallets to the machine. This equipment is very well known in the cement block industry and will not be detailed.

To briefly indicate this integration, the block diagram indicates an arrangement common with the cited Besser product except for the defeathering station 10. A block making machine 12 forms new blocks on plate metal pallets that are automatically conveyed as indicated by line 14 to a rack assembly 16. A rack is automatically loaded with the new blocks. When flled, it may be taken to a steam room wherein by the next day the blocks are dried sufficiently to be unloaded. This means that a rack can be loaded and taken to a steam room overnight and then can be unloaded and reloaded the next day. Rack assembly 16 automatically unloads dried blocks from a rack, still on their metal pallets, and delivers them, as indicated by line 18, to depalleter 19, which delivers the dried blocks to conveyor 20 and separates the metal pallets and feeds the metal pallets to the machine 12. Conveyor 20 can be of a common type with parallel rotatably mounted rods on which the blocks are conveyed. Usually the blocks will be delivered by depalleter 19 to conveyor 20 in sidewise disposition and a turntable 21 is interposed in conveyor 20 to rotate the dried blocks 90° to be fed to defeathering station 10 in endwise disposition and to be delivered to the cubing station 23 in endwise disposition. According to conventional practices, the dried blocks at cubing station 23 are loaded on wood pallets (for fork truck handling) either by semiautomatic handling equipment or manually. As before indicated everything described has been common and well known that has been described thusfar except the integration of my new defeathering station 10 into conveyor 20.

It will be understood that it would be an economical and convenient expedient to integrate defeathering into the conveyor 20. Defeathering of blocks at station 10 is automatic in the sense that an operator does not have to be constantly in attendance. In fact an operator is not needed except in case of malfunctioning. Operators will be involved with a block making machine, i.e., although the operation is considerably automated, racks are delivered and taken away, an operator monitors performance of machine 12 and makes needed adjustments, etc., so there will be an operator available to "keep an eye" on the defeathering station but he would be rarely needed. In the following description, it will be evident that my defeathering means and method do not need to be integrated into the other operations depicted in FIG. 7. The means and could be used later or separately. The point is that such integration is advantageous, so as to not involve another operation or other operators, to avoid additional handling, to defeather before there is any manual handling, etc.

I will now deal with the means and method employed at station 10. Conveyor 20 is a standard-type conveyor used in various industrial and business applications, that may be powered or not depending on inclination and other factors, to deliver articles. Essential parts are side rails 22 and parallel spaced-apart rollers 24 rotatably mounted relative to side rails 22. It is desirable at least at the defeathering station 10 to power rollers 24. This I have illustrated diagrammatically in FIG. 5 by sheaves 26 on one end of the roller shafts 28 and powered by a belt 30 driven by a motor, not shown, which, in practice, may be the same motor used to power other rotating members at the defeathering station.

Figure 2:
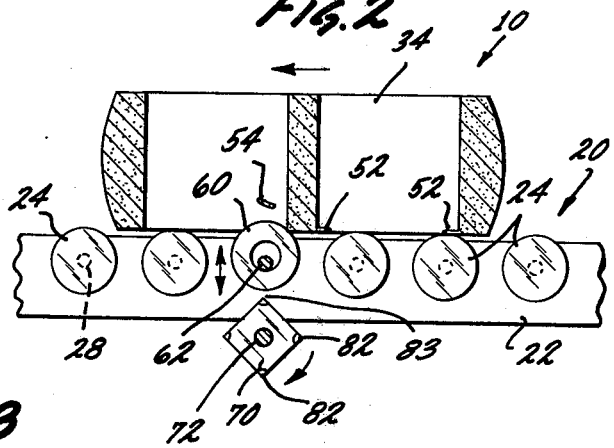
FIG. 2 is similar to FIG. 1 but with certain parts in different positions in the defeathering process.

Blocks 34 are moved through the defeathering station 10, in the direction of the arrows of FIGS. 1, 2 and 7, by the rollers 24 powered as above described. Preferably they are held down, with minimum pressure, by an upper roller 36 which is covered with rubber material 38 or the like. Roller shaft 40 will be seen from FIG. 4 to be rotatably supported at the end of an arm 42 which has a pivotal connection 44 to a standard 46. Roller 36 is adjusted in the pressure applied by resilient material 38 (and can be adjusted for heights of blocks) by a pair of nuts 48 on a threaded rod 50 and bearing on either side of arm 42, which has an opening through which rod 50 extends. More than one block, side-by-side, can travel through the defeathering station at the same time, in the same general side-by-side disposition they have on pallets when formed and dried.

The blocks 34 viewed are slump blocks (with curved outer walls) and, as indicated, feathers are a problem with slump blocks. Feathers extending from lower surfaces are shown at 52 in FIGS. 1 and 2. A feather that has been knocked off is shown at 54 in FIG. 2. The feathers are removed by a multiplicity of blows on the lower surfaces of the blocks, directed substantially vertically upwardly and spread across lines disposed transversely of the path of travel of blocks 34 and serially repeating the simultaneous multiplicity of blows as the blocks progress through defeathering station 10. The blows are struck with a series of juxtaposed members supported below the path of travel of blocks 34. The juxtaposed members move from lower positions below the blocks to upper positions striking the bottoms of the blocks and the feathers extending therefrom.

The preferred means for striking the blocks to knock off the feathers includes a series of hardened steel washers 60 hung from a rod 62 which is rotatably supported between rails 22, free to spin, as it has been found that the striking action of washers 60 is improved and the wear distribution is better if rod 62 can spin. Washers 60 can be standard-sized, hardened steel washers, i.e., a suitable size is 2 inches O.D., 1 inch I.D., and about ⅛ inch thick. Rod 62 may be about ½ inch in diameter. Washers 60 may be spaced apart by smaller diameter spacing washers 64 interfingered with hardened washers 60 (washers 60 may have a Rockwell hardness of 41–45). For the 2 inch washers 60 cited, 1 ½ inch spacing washers 64 are suitable (⅝ inch I.D. and about 3/32 inch thick). Washers 60 hang free from rod 62 in the lower position indicated in FIG. 1 below the lower surfaces of blocks 34 except when upwardly propelled, as indicated in FIG. 2, to an upper position, striking the lower surfaces of the blocks and the feathers 52, knocking them loose as indicated at 54 in FIG. 2. A feather 52 may be knocked off completely, flush with the adjacent wall. A feather may taper as it extends away from the wall and only the outer portion may be broken off sometimes, in effect blunting the feather but leaving a portion extending beyond the normal plane of the adjacent wall. In that case, the blunted feather is not particularly objectionable as the blunted feather has nominal length and is not sharp enough to interfere much with handling.

Figure 3:
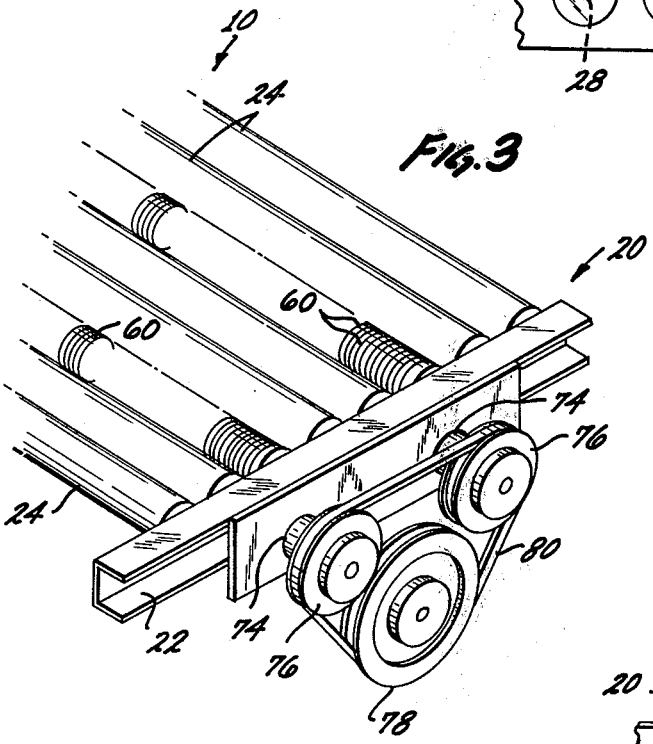
FIG. 3 is a partial perspective view of part of the defeathering apparatus.
Figure 4:
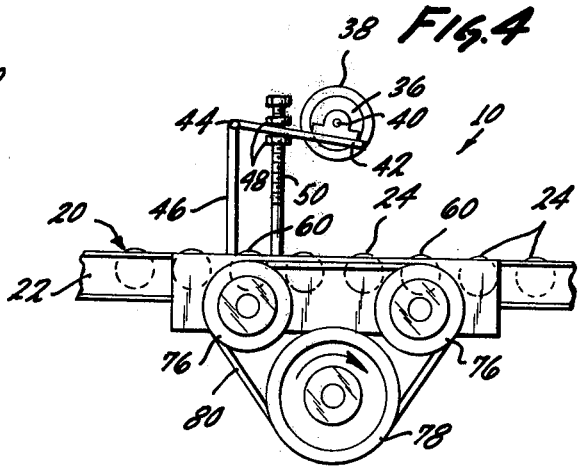
FIG. 4 is a side view of the apparatus.

It will be observed from FIGS. 3 – 5 that preferably two banks of washers 60 are provided, on two lines transverse of conveyer 20, separated by a pair of rollers 24. This means that a feather not knocked off by a first bank of washers 60 may be disposed of by the second bank of washers. The separations of the banks by rollers 24 avoids tipping of the blocks due to limitations of support.

The means to propel washers 60 upwardly are preferably squared shafts 70. Shaft dimensions of 1 ¾ × 1 ¾ inches are suitable. The stub shaft ends 72 of shafts 70 are suitably rotatably supported by bearings 74 and have sheaves 76 at their ends. A driving sheave 78, powered by a motor not shown, is connected to sheaves 76 by belt 80. A speed of 1000 rpm is suitable for shaft 70. The corners 82 of squared shafts 70 may be hard faced with borium carbide rod to increase the shaft life.

When the flats of shaft 70 are presented to washers 60, the washers preferably hang entirely free and have the lower position shown in FIG. 1 in which the washers 60 and the flats of shaft 70 are separated ⅛ inch or more as shown at 81. When the corners 82 of shaft 70 strike washers 60, the washers are upwardly propelled to strike the bottom surfaces of the blocks and feathers 52. Washers 60 are struck to propel them upwardly but are not driven all of the way up (to reduce wear on the squared shaft and the washers) and it will be observed in FIG. 2 that in the uppermost position of washers 60 they are separate from corners 82 at 83 and around ¼ inch separation would be suitable. In the FIG. 1 position, preferably the tops of washers 60 are below the planes of the bottoms of blocks 34 (as defined by the plane of the tops of rollers 24), i.e., ¼ inch would be suitable. This disposition is consistent with the other relationships, i.e., washers 60 are struck and are in "free flight" when they strike feathers 52 rather than being pushed against the feathers.

It will be understood that a square shaft is convenient to manufacture but the basic requirement of shaft 70 is that it be non-circular with portions of minimum diameter (the flats, in the case of a squared shaft) and with portions of greater diameter (the corners, in the case of a squared shaft), so that the rotation of shaft 70 plus the influence of gravity will produce up and down movements of washers 60.

The foregoing describes the apparatus and the method of defeathering blocks, and how the objectives of the invention have been met. Defeathering is automated and integrated into other block making operations. Minimum operator attendance is required. The apparatus is durable and should require little maintenance except for replacement of parts having reasonable lives.

Having thus described my invention, I do not wish to be understood to limit myself to the exact details of the structure described. Instead, I wish to cover those modifications thereof that will occur to those skilled in the art upon learning of my invention, properly within my invention coverage.

I claim:

1. Means defeathering the lower portions of cement blocks at a defeathering station, comprising:

a. means supporting and conveying said blocks in a generally horizontal path of travel past said defeathering station, b. a series of juxtaposed members and means supporting said juxtaposed members on a line below and extending laterally of said path of travel of said blocks at said defeathering station, said means supporting said juxtaposed members permitting them to move freely generally vertically from a first lower position to a second upper position, c. means operative to periodically strike said justaposed members and to thereby propel said juxtaposed members upwardly from said first lower position to said second upper position, said juxtaposed members in moving from said first lower position to said second upper position thereby striking said lower portions of said blocks and thereby knocking feathers from said blocks, d. said means supporting said juxtaposed members being a rod disposed transversely of said path of travel of said blocks and disposed therebelow and said juxtaposed members having openings therein in which said rod is positioned and said openings being larger than said rod thereby permitting said juxtaposed members to move from said first lower position to said second upper position, e. said rod being of circular cross-section and said juxtaposed members being annular members and said openings being circular so that said annular members can rotate on said rod to permit different surfaces to strike said blocks to distribute wear on said annular members, and means mounting said rod free to rotate, the axis of said rod being stationary.

2. The subject matter of claim 1 in which said annular members are washers hung on said rod, and said first lower position is the position said washers assume on said rod under force of gravity.

3. The subject matter of claim 2 in which said washers are formed of steel hardened material.

4. The subject matter of claim 2 in which there is a second series of smaller-diameter spacing washers interfingered with said first-mentioned washers.

5. The subject matter of claim 1 in which said means operative to periodically strike said juxtaposed members is a powered rotating shaft located therebelow, said shaft being non-circular in cross-section and having at least one lesser diameter portion and having at least one greater diameter portion, said shaft being located relative to said juxtaposed members so as to strike said juxtaposed members at least with some greater diameter portion during shaft rotation and thereby to propel said juxtaposed members from said first lower position to said second upper position.

6. The subject matter of claim 5 in which said shaft intermediate its ends is square in cross-section and said greater diameter portion being formed by the corners of the square cross-section.

7. The subject matter of claim 6 in which said corners are hard faced.

8. The subject of claim 1 in which said means supporting and conveying said blocks is a conveyor with spaced-apart parallel rollers, said series of juxtaposed members being positioned between a pair of adjacent rollers.

9. The subject matter of claim 8 in which at least part of said rollers are powered.

10. The subject matter of claim 8 in which there is a roller bearing on the top of said blocks at said defeathering station.

11. The subject matter of claim 1 in which there is a cement block making machine and drying racks at said machine and means operative to unload dried blocks from said drying racks and said means supporting and conveying said blocks in a conveyor operative to receive dried blocks from said means operative to unload dried blocks.

12. The process of defeathering the lower portions of cement blocks at a defeathering station, comprising:

a. bringing said blocks on a path of travel through said defeathering station with their lower surfaces substantially horizontally disposed, b. supporting on a rod below said station and lateral of said path a series of washer-like juxtaposed members with central openings larger than said rod whereby said members can be moved vertically relative to said rod, and c. at said station striking said juxtaposed members from below causing said members to be propelled upwardly and to strike said lower surfaces from below generally vertically upwardly and spread across a line disposed transversely of said path of travel of said blocks and serially repeating simultaneous multiplicity of blows as the blocks progress on said path of travel, thereby breaking feathers from said blocks.

13. The process of claim 12 in which said path of travel is included in the path of travel in conveying blocks away from drying racks at a block making machine.

* * * * *